United States Patent [19]

Lee

[11] 4,294,125

[45] Oct. 13, 1981

[54] PIPETTE CONTROLLER WITH GRADUATE READING PLUNGER AND LEVER ASSEMBLY FOR GRAVITY DRAINAGE

[76] Inventor: Tsao-Piao Lee, No. 89-1, Chang Chun Rd. 2nd Floor, Taipei, Taiwan

[21] Appl. No.: 143,270

[22] Filed: Apr. 24, 1980

[51] Int. Cl.[3] ..... B01L 3/02

[52] U.S. Cl. ..... 73/864.15; 73/864.18

[58] Field of Search ..... 73/425.4 P, 425.6

[56] References Cited

U.S. PATENT DOCUMENTS

| | | | |
|---|---|---|---|
| 2,172,575 | 9/1939 | Caufield | 73/425.6 |
| 3,302,462 | 2/1967 | Pursell | 73/425.6 |
| 3,809,297 | 5/1974 | Poulten | 73/425.6 |
| 4,016,765 | 4/1977 | Lee | 73/425.6 |
| 4,133,211 | 1/1979 | Sarstedt | 73/425.6 |

*Primary Examiner*—S. Clement Swisher

[57] ABSTRACT

A pipette controller comprising a coil spring arranged in a cylinder between the bottom of the cylinder and the piston for biasing said piston to a predetermined position in which a graduate reading plunger in thread engagement with a threaded rod mounted on a piston projects through a hole in the top of a cylinder cap, and a double-sealing means adapted to be engaged with a port formed on the bottom of the cylinder for sealing the end of a pipette to the controller with the interior of the pipette in communication with the chamber defined by the piston and cylinder.

A lever assembly is provided which vents the interior of the cylinder to facilitate gravity drainage of the pipette. Both the plunger and the lever assembly can be operated easily with one hand.

6 Claims, 3 Drawing Figures

8
13
131
20
132
133
175
176
15
15'
151'
152'
152'
16
17
172
173
171
174
18
3
1
2
25
20
15
10
5ml
121
12
4
41
6
5
51
10

PIPETTE CONTROLLER WITH GRADUATE READING PLUNGER AND LEVER ASSEMBLY FOR GRAVITY DRAINAGE

BACKGROUND OF THE INVENTION

This invention relates to a pipette controller and, more particularly to an improved pipette controller which is formed in a very compact structure so that it can be used easily with one-hand.

Some pipette controlling means are known, such as the one described in U.S. Pat. No 3809297 issued May 7, 1974 to John Poulten Limited, where a helical spring is used for biasing piston upward to a predetermined position in order to draw liquid into the pipette, said helical spring is arranged in a generally cylindrical cover. In order to contain the extended helical spring, this cylindrical cover should have a substantial large volume which is almost the same as that of the cylindrical device which is connected to the cylindrical cover, hence the entire volume of such pipette controller is substantially increased. In addition, the construction of such pipette controlling means is somewhat complicated due the fact that two rods in screw-threaded engagement with each other are used for varying the length of the piston rod. And a spring clip is used for movably closing an aperture in the bottom of the cylinder in order that the aperture can be opened to atmosphere for discharging liquid from the pipette. However, in order to open aperture to atmosphere, the spring clip needs to be pressed downwards by the same hand that holds the pipette controlling means, thus making one-handed operation of the pipette controller difficult.

Accordingly, it is an object of the present invention to overcome the above disadvantages.

It is a further object of this invention to provide a pipette controller that permits convenient operation and excellent control for pipetting with the facilities of the graduate reading device for presetting the volume of liquid to be filled.

It is another object of this invention to provide a compact pipette controller having a coil spring arranged in a cylinder between the bottom of the cylinder and the piston for biasing the piston to a predetermined position which eliminates the need to add complicated and space-consuming parts to contain the coiled spring.

It is another object of this invention to provide a pipette controller utilizing a hand controller for controlling the natural drainage of the liquid by means of a lever action.

It is another object of this invention to provide a pipette controller utilizing a double-sealing means which can sealingly grip the end of the pipette.

According to this invention, the pipette controller comprises a cylinder having, at its tubular extension, a port provided with two seal members and a collet for sealingly gripping the end of a pipette; a cylinder cap mounted on the upper end of the cylinder; a piston capable of reciprocation inside the cylinder; a coil spring arranged in the cylinder between the piston and the bottom of the cylinder for biasing piston to a predetermined position; a threaded rod having one end connected to the piston and the other end connected with a plunger movably projecting through an opening on the top of the cap, said plunger includes radial flange on the lower end thereof to be biased against the inner side of the top of the cap by said coil spring for normally maintaining the upper end of the plunger projected outside the cap, said plunger further includes a hollow tubular member of transparent material, a nut member for threadedly engaging the threaded rod such that the upper end of the thread rod will be caused to ascend or descend with respect to the wall of the tubular member when the plunger is turned, and, a set of graduations is provided on the surface of the wall of the tubular member in cooperation with an indicating means provided on the upper-most end of the threaded rod inside the tubular member to indicate the volume of the liquid being sucked in by the travel of the piston. In a preferred embodiment, the tubular extension of the cylinder is further provided with a second port communicating to atmosphere via a channel; which channel is normally closed by means of an operable lever system attached to the barrier for controlling the natural drainage of the liquid.

This invention will become fully apparent from the detailed description with reference to the accompanying drawings which are given by way of illustration only, and thus are not limitative of this invention.

DETAILED DESCRIPTION OF PREFERRED EMBODIMENT

Figure 1:
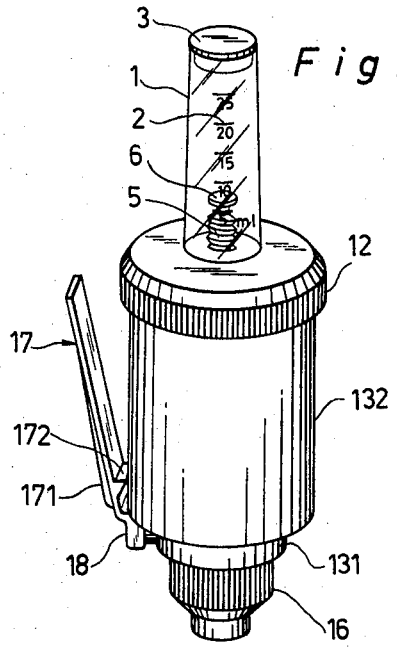
FIG. 1 is a perspective view of one embodiment of the pipette controller according to this invention.
Figure 2:
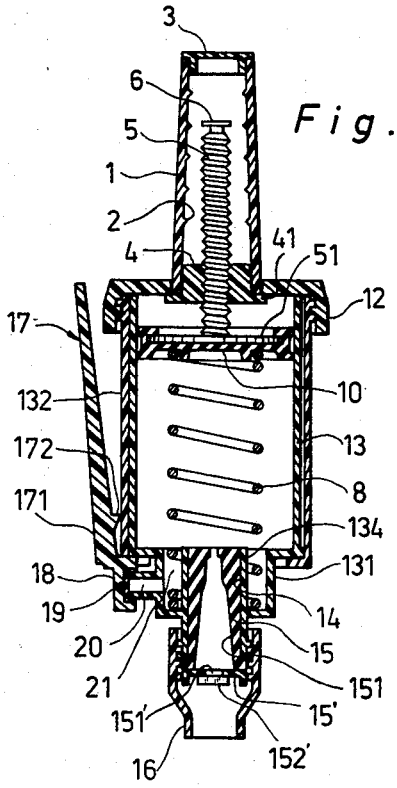
FIG. 2 is a longitudinal sectional view of the pipette controller shown in FIG. 1.
Figure 3:
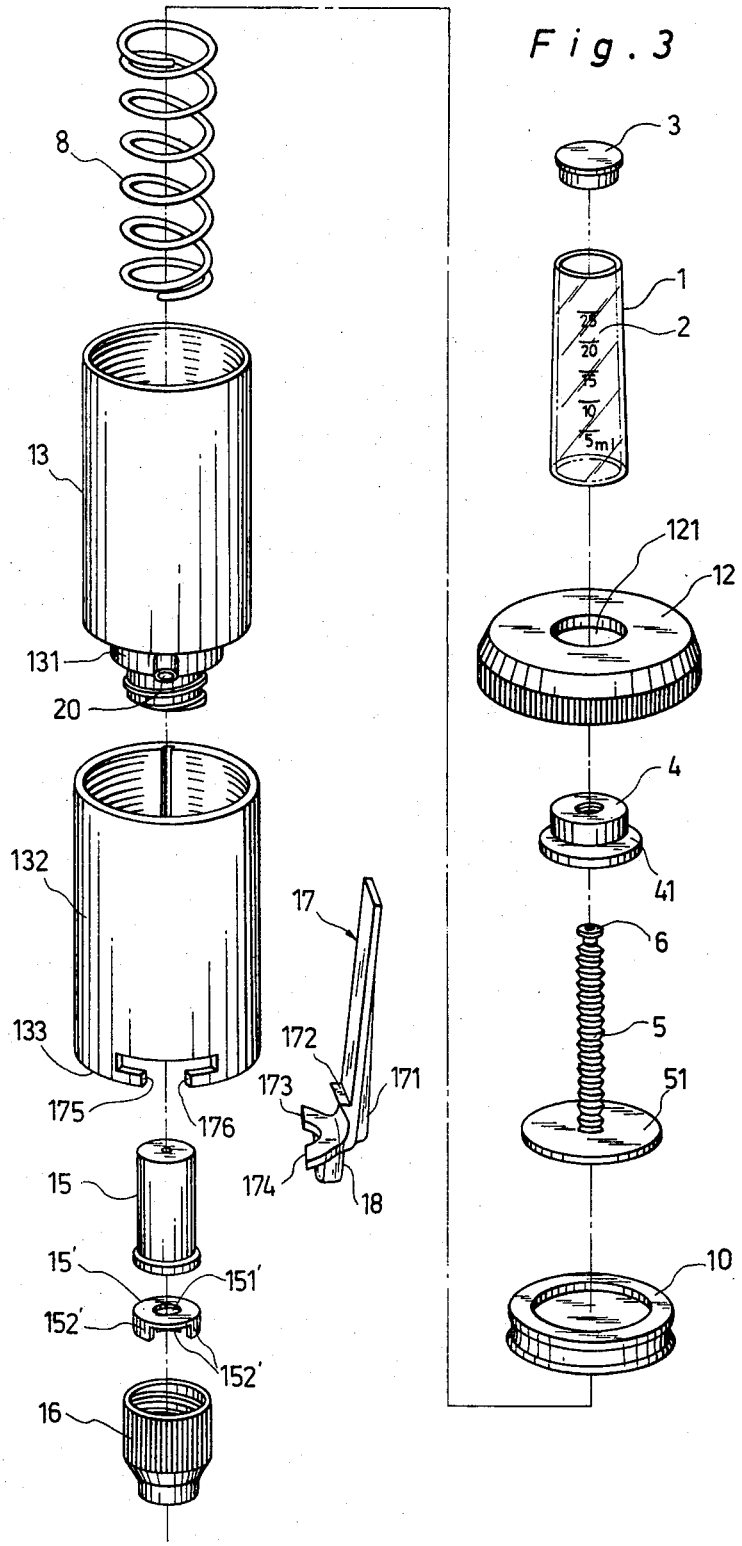
FIG. 3 is an exploded view of the pipette controller shown in FIG. 1.

Referring to FIGS. 1–3, there is shown an embodiment of this invention. The pipette controller comprises a cylinder 13 which defines a piston chamber and which is covered by a cap member 12, and has a tubular extension 131 formed at the bottom thereof. The tubular extension 131 is provided at its lower end with a port 14 which is provided with upper and lower seal members 15, 15' and a collet 16 in such a manner that the end of a pipette inserted therein may be tightly connected. The tubular extension 131 is double-walled in order that its inner tubular 134 wall will serve as a holder for holding a coil spring 8.

The piston 10 is slidably received in the piston chamber, and is secured to a support flange 51 of a piston rod 5. The piston rod 5 is formed in a threaded rod for threadedly engagement of a plunger 1. The coil spring 8 is arranged in the cylinder between the bottom of the tubular extension 131 and the piston 10 for biasing piston to a predetermined position in which the plunger 1 is biased to a top dead point with the flange 41 thereof in contact with the inner face of the cap member 12. Therefore, the travel of the piston 10 inside the cylinder 13 may be effected by depressing and releasing the plunger 1. In other words, a pipette connected at the port 14 may be pipetted by depressing and releasing the plunger. The plunger 1 movably extends from inside the cap member 12 which is secured on a movable barrier 132, to outside through a central hole 121 provided in the top of the cap member, and has a radial flange 41 to coincide with the peripheral edges of said hole 121. The plunger 1 is a tubular member of transparent material, which is closed at upper end by a lid 3, and is connected at lower end with a nut member 4. The nut member 4 has a threaded hole for threadedly engaging and guiding the piston rod 5 so that an indicating disc 6 mounted on the upper end of the piston rod is caused to ascend or descend with respect to the wall of the plunger 1 when the plunger is turned in either clockwise or counter clockwise direction, such that the position of the piston inside the cylinder may be finely adjusted by turning the plunger. In addition, a set of graduations 2 are provided on the inner or outer surface of the wall of the plunger 1, which are calibrated in volume unit according to the amount of liquid pipetted by the travel of the piston. Moreover, an indicating disc 6 is fixed on the uppermost end of the rod 5 for taking readings in response to the position of the piston.

A double-sealing means comprises an upper seal member 15 which is formed in a T-tubular shape, and which is provided with a bell-shaped aperture 151 adapted for receiving pipette ends of different diameters, and which is adapted to be received in the port 14, and a lower seal member 15' adapted to be received in the collet 16 is also formed in a tubular shape. A gripping hole 151' is formed on the top of the lower seal member, and the peripheral wall of the lower seal member has three cut-out portions being formed in three equal segments of a circle to form three lips 152' for sealingly gripping the end of the pipette when the collet 16 is screwed up.

As shown in FIG. 2, the tubular extension 131 of the cylinder 13 is provided with a second port 21 which is communicated to atmosphere via a laterally extending channel 20. A hand controller 17 including an operable lever system is provided on the lower peripheral wall of a movable barrier 132 which is slidably engaged with the cylinder 13 to normally close the opening of the channel 20, and to open it when manually actuated on the principle of lever. The operable lever system, as shown in FIG. 3, comprises a lever arm 171. One end of the lever arm is formed with a seal holder 18, a pair of lugs 173, 174, and a projection 172. The lugs 173, 174 are adapted to be locked by a pair of claws 175, 176 which are formed on the lower rim 133 of the barrier 132 by cutting out a T-shaped portion of the rim 133, in such a manner that the opening of the channel 20 is tightly closed by a seal pad 19 held by the seal holder 18, and the projection 172 is in contact with the surface of the barrier 132 as shown in FIG. 2.

In the operation of the pipette controller, the end of a pipette will be sealingly held by the upper and lower seal members simply by insertion of said end into said seal members without screwing the collet 16. Thereafter, the volume of liquid to be pipetted is preset by turning the plunger 1 to bring the indicating disc 6 to coincide with the desired graduation. Depress the plunger 1 until the bottom dead point is reached and insert the jet of the pipette into the liquid to be pipetted, then release depressing force, and the plunger will return to the released position, the preset volumes of liquid to be pipetted can be obtained just with minor adjustment for precise setting on the graduation lines marked on the pipette. Thereafter, the pipette may be discharged by gently depressing the plunger 1 to expel the liquid, or by turning the plunger 1 in a counter clockwise direction to obtain excellent control of fractional delivery. Alternatively, when the accuracy of the pipette being used depends on natural drainage, the hand controller 17 should be used, i.e. The lever arm 171 is biased toward the barrier with the projection 172 serving as a fulcrum to slightly maintaining the seal pad 19 away from the opening of the channel 20, allowing the atmosphere pressure be directed into the space between the piston and the end of the pipette via the channel 20, and thus causing the liquid to flow out by gravity. Also, this hand control can be used to deliver volumes of liquid between graduation lines marked on the surface of the pipette.

The pipette controller in accordance with this invention is operated by thumb and forefinger, furnishes all functions being required for pipetting such as liquid drawing, repetitive fillings for preset volumes, and liquid dischargings inclusive of natural drainage for bulb pipettes, fractional delivery, titration capability, to deliver volumes of liquid between graduation lines marked on the pipettes, and liquid-expelling, in a safe, quick, convenient and reliable condition.

What I claim is:

1. A pipette controller comprising:

a cylinder;

a piston disposed in said cylinder;

a threaded rod operatively coupled to said piston;

a spring arranged in said cylinder between the bottom thereof and said piston for biasing said piston to a predetermined position;

a cylinder cap having a hole therein, said cap being coupled to said cylinder;

a graduate reading plunger in thread engagement with said threaded rod and disposed through said hold in said cylinder cap;

sealing means including a port for receiving the end of a pipette, the sealing means being disposed at the bottom of the cylinder for sealing the end of the pipette to the controller and placing the interior of the pipette in communication with a chamber defined by the piston and cylinder, said cylinder having a port for communicating with the atmosphere via a channel;

an operable lever assembly adapted to selectively close the port of said channel, said operable lever assembly including a lever arm including a pair of lugs and a seal pad for selectively sealing said channel, a member having a pair of claws for engaging the lugs of said lever arm and projection means for providing a fulcrum for said lever arm, said controller providing natural drainage when the end of the lever arm remote from said pair of lugs is biased toward said cylinder.

2. A pipette according to claim 1, wherein said spring is a coil spring and said cylinder has a double-walled tubular extension, the inner wall thereof serving as a holder for said coil spring.

3. The pipette controller according to claim 1, wherein the sealing means comprises an upper seal member having a bell-shaped aperture adapted for receiving pipette ends of different diameters and a lower seal member having a gripping hole formed on the top thereof, said lower seal member having three cut-out portions formed in three essentially equal segments of a circle to form three wall portions.

4. The pipette controller according to claim 1, wherein said member is provided by a cylindrical barrier disposed outwardly of said cylinder.

5. The pipette controller according to claim 4, wherein said projection means is disposed on said lever arm and bears against said barrier.

6. The pipette controller according to claim 4, wherein said pair of claws are formed on the lower rim of said barrier by cutting out a T-shaped portion of the rim of said barrier and wherein said lever arm is detachably biasingly locked thereto.

* * * * *